US010501907B2

(12) United States Patent
Freitag et al.

(10) Patent No.: US 10,501,907 B2
(45) Date of Patent: Dec. 10, 2019

(54) MOULDING INSERT AND FACING BLOCK WITH SUCH AN INSERT

(71) Applicant: TERRE ARMEE INTERNATIONALE, Rueil Malmaison (FR)

(72) Inventors: Nicolas Freitag, Orsay (FR); Yassine Bennani, Croissy S/seine (FR)

(73) Assignee: TERRE ARMEE INTERNATIONALE, Rueil Malmaison (FR)

( * ) Notice: Subject to any disclaimer, the term of this patent is extended or adjusted under 35 U.S.C. 154(b) by 0 days.

(21) Appl. No.: 15/742,357

(22) PCT Filed: Jul. 5, 2016

(86) PCT No.: PCT/FR2016/051698
§ 371 (c)(1),
(2) Date: Jan. 5, 2018

(87) PCT Pub. No.: WO2017/006043
PCT Pub. Date: Jan. 12, 2017

(65) Prior Publication Data

US 2018/0195251 A1 Jul. 12, 2018

(30) Foreign Application Priority Data

Jul. 7, 2015 (FR) ..... 15 56425

(51) Int. Cl.
*E02D 29/02* (2006.01)

(52) U.S. Cl.
CPC ..... *E02D 29/0266* (2013.01); *E02D 29/025* (2013.01); *E02D 29/0241* (2013.01); (Continued)

(58) Field of Classification Search
CPC ..... E02D 29/0241; E02D 29/0225; E02D 29/0233; E02D 29/025; E02D 17/202; (Continued)

(56) References Cited

U.S. PATENT DOCUMENTS 5,839,855 A 11/1998 Anderson et al.
8,790,045 B2 7/2014 Cariou
(Continued)

FOREIGN PATENT DOCUMENTS

EP 2 247 797 B1 5/2012
EP 2 567 032 B1 6/2014

OTHER PUBLICATIONS

International Search Report from PCT/FR2016/051698, dated Sep. 15, 2016.

*Primary Examiner* — Carib A Oquendo
(74) *Attorney, Agent, or Firm* — Dentons US LLP

(57) ABSTRACT

Moulding insert (8) for a mould manufacturing a concrete facing block (4) for a reinforced-ground structure (90), said reinforced-ground structure comprising a facing formed by such facing blocks and a fill in which reinforcements connected to the facing are installed, the moulding insert (8) comprising a shell (1), delimiting a general space of a connection connecting a reinforcement (3) to the facing block, a core envelope (2) obtained by moulding the shell separately, the shell having a first lateral face (15) pierced with a first orifice (11), in which a first end portion (21) of the core envelope is fitted, characterised in that the core envelope is in the general form of a truncated cone.

13 Claims, 6 Drawing Sheets

(52) U.S. Cl.
CPC .. *E02D 29/0233* (2013.01); *E02D 2250/0007* (2013.01); *E02D 2250/0023* (2013.01); *E02D 2300/002* (2013.01); *E02D 2600/30* (2013.01)

(58) Field of Classification Search
CPC .... E02D 2250/0007; E02D 2250/0023; E02D 2300/002; E02D 2600/30; E02D 29/0266
See application file for complete search history.

(56) References Cited

U.S. PATENT DOCUMENTS

| | | | |
|---|---|---|---|
| 8,985,900 | B2 | 3/2015 | Freitag et al. |
| 2011/0044771 | A1 | 2/2011 | Freitag et al. |

MOULDING INSERT AND FACING BLOCK WITH SUCH AN INSERT

This application is a National Stage Entry of International Application No. PCT/FR2016/051698, filed Jul. 5, 2016, and claims the benefit of and priority to French Application No. 15 56425, filed Jul. 7, 2015, all of which are hereby incorporated by reference in their entirety for all purposes as if fully set forth herein.

The present invention relates to civil-engineering structures of the reinforced ground type, for example a fill, a dyke, a gravity dam, a supporting block, a fluid-retention catchment bank, a bridge pier, etc. This type of structure normally comprises a facing and a fill in which reinforcements connected to the facing are installed.

The present invention relates in particular to the facing elements, often in the form of prefabricated concrete blocks, the constitution thereof and the method for obtaining such facing blocks.

More precisely, the concern is with the areas where the fill reinforcements are attached to the inside of the facing block.

Various solutions and configurations for attaching to the facing a continuous reinforcement with an outward length, a loop that passes around an anchoring core in the facing block and a return length are known from the prior art. The documents U.S. Pat. Nos. 5,839,855 and 8,790,045 can in particular be cited.

According to the known art, a plastic moulding insert is placed in a mould intended for manufacturing a facing block, and then concrete is poured in liquid form into the space provided for the facing block, part of the concrete coming to occupy a space corresponding to the anchoring core designed to hold the fill reinforcement, but without occupying a cavity reserved for the passage of the fill reinforcement.

In addition, in some cases, this moulding insert fulfils a sealing role and prevents the liquid concrete arriving in the cavity in which the reinforcement will pass through once installed. The contact between the concrete and the reinforcement could cause premature degradation of the latter. In some other cases, this moulding insert also fulfils the role of sealing in the finished structure.

The inventors remarked firstly that the manufacture of such moulding inserts presented certain difficulties and proved to require complex moulds. Moreover, the inventors remarked that these known moulding inserts, which must be transported from their own manufacturing site to the site where the facing blocks are prefabricated, occupy a large amount of space compared with the volume of material (in other words the void fraction is high in the packages).

There therefore exists a need to further optimise the moulding inserts, the manufacture thereof and the installation thereof in the block prefabrication mould, while keeping good properties of mechanical strength required for the connection/binding between the facing blocks and the reinforcements in the fill and therefore for good coherence of the structure to be erected.

To this end, according to the invention, a moulding insert is proposed, configured so as to be inserted in a mould for manufacturing a concrete facing block intended for a reinforced-ground structure, said reinforced-ground structure comprising a facing formed by such facing blocks and a fill in which reinforcements are installed, preferably in the form of bands, connected to the facing, the moulding insert comprising:

a shell, delimiting a general space of a connection connecting a reinforcement to the facing block, said general space opening up while splaying towards a reference plane P, a core envelope, obtained by moulding, separately from the shell, the shell having a first lateral face pierced with a first orifice in which a first end portion of the core envelope is fitted, characterised in that the core envelope is in the general form of a truncated cone.

By virtue of these provisions, before assembly, a plurality of core envelopes can be stacked on top of one another, and a plurality of shells can be stacked in one another, which considerably reduces the void fraction in the packages transporting these pieces, which makes the solution overall less expensive. In addition, such a core envelope can easily be assembled in such a shell in order to form a moulding insert intended to create a cavity used subsequently as a connection with a reinforcement.

In various embodiments of the invention, it is optionally possible to have recourse also to one or other or all of the following provisions:

- the shell has a second lateral face pierced with a second orifice in which the second end portion of the core envelope is fitted; advantageously, at the time of assembly, it is possible to obtain a simultaneous wedging of the core envelope respectively in the two lateral faces of the shell;
- the fitting together is done without any substantial clearance, benefiting from a wedge effect of the frustoconical shape of the core envelope, at the first end portion and the second end portion; there is thus obtained, between the thus obtained, between the two pieces, a sufficiently closed interface to prevent the poured concrete entering the cavity intended to receive a reinforcement;
- the conicity $\alpha 1$ of the core envelope is between 1 degree and 10 degrees; the difference in size between the narrow side and the wider side of the truncated cone shape remains small, and the strength of the core to be obtained is therefore not very asymmetric; in addition, before actual use, a plurality of core envelopes can be stacked, forming a compact stack, and transport thereof is easy;
- the second orifice is larger than the first orifice; advantageously, at the time of assembly, it is possible to fit the core envelope easily through the second orifice with a comfortable clearance,
- the first orifice has a form corresponding to the form of the first end portion and the second orifice has a form corresponding to the form of the second end portion; in this way a closed continuous interface is obtained both on the periphery of the first orifice and on the periphery of the second orifice;
- in addition, the form of the second end may be obtained by homothetic transformation from the first ends; so that the core envelope forms an exact truncated cone, without singularity of form, which procures satisfactory strength for the anchoring core obtained subsequently;
- preferably the two orifices have similar forms and the ratio of their sizes corresponds to the ratio of the cross sections of the first and second end portions; by means of which homogeneous wedging is obtained, which occurs at the same time at the first orifice and second orifice, and in this way a "natural" basic sealing is obtained between the core envelope and the shell;

the shell is obtained by moulding in a single piece; which is made possible by the splayed form of the shell;

alternatively, the shell may be obtained in two pieces, that is to say with a body and a cover;

the shell and the core envelope are moulded from injectable thermoplastic material, of the polyethylene, polyolefin or polypropylene type; in this way an inexpensive material that is easy to use is advantageously utilised;

the shell and the core envelope have sufficient flexibility to deform at the interface between the core envelope and the orifices of the shell, with preferably a wall thickness of between 0.5 mm and 2 mm; this flexibility makes it possible to form a continuous contact joint over the entire periphery of the orifices, which makes it possible to obtain a satisfactory seal for the majority of normal configurations;

it is possible to form a welding joint specific to the interface between the core envelop and the shell; which makes it possible to obtain a high degree of sealing for the moulding insert and therefore for the final structure;

the shell may abut on a rear sealing membrane of the block, by means of a rim arranged in the reference plane P; it is thus possible to achieve a complete seal over the entire rear face of the facing block, including in the zone where the reinforcement is attached;

the reference cross section of the conical core envelope has an ovoid shape; which proves to be an optimised shape in terms of tensile strength exerted by the reinforcement and for easy fitting of the reinforcement and the protection of the reinforcement;

the respective centres of the first and second orifices have positions offset in distance with respect to the reference plane P, so that the axis of the core envelope W has an inclination $\alpha 2$ vis-à-vis the reference plane, so that a travel length of the reinforcement is obtained that is identical over the width of the reinforcement, and so that creating an imbalance in tension between one side and the other of the reinforcement band is avoided.

Moreover, the invention also relates to a method for producing a moulding insert:

providing a shell, designed to delimit a general space of the connection connecting a reinforcement to the facing block, said general space opening up by splaying towards a reference plane P, providing a core envelope, obtained by moulding, separately from the shell, the core envelope having the general form of a truncated cone, assembling the core envelope in the shell.

Other aspects, aims and advantages of the invention will emerge from a reading of the following description of several of the embodiments thereof, given by way of non-limitative examples. The invention will be better understood with regard to the accompanying drawings, in which.

In the various figures, the same references designate identical or similar elements.

By way of example, a civil-engineering structure according to the invention may be a dam, a dyke, a fluid-retention structure, a canal bank, a construction intended to widen or raise an existing structure, a slope circumscribed by a facing, a bridge pier or more generally any other civil-engineering structure.

Figure 1:
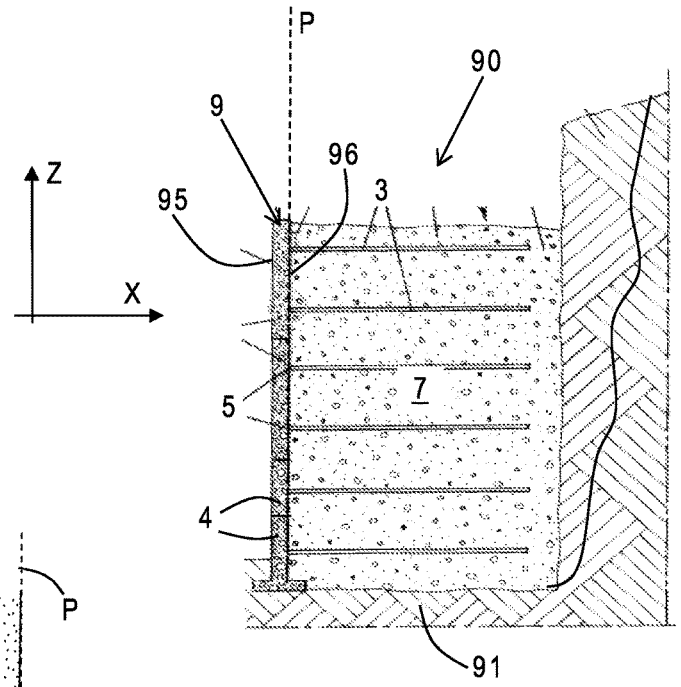
FIG. 1 is a schematic view in cross section of a civil-engineering structure in which the invention is put into practice.
Figure 2:
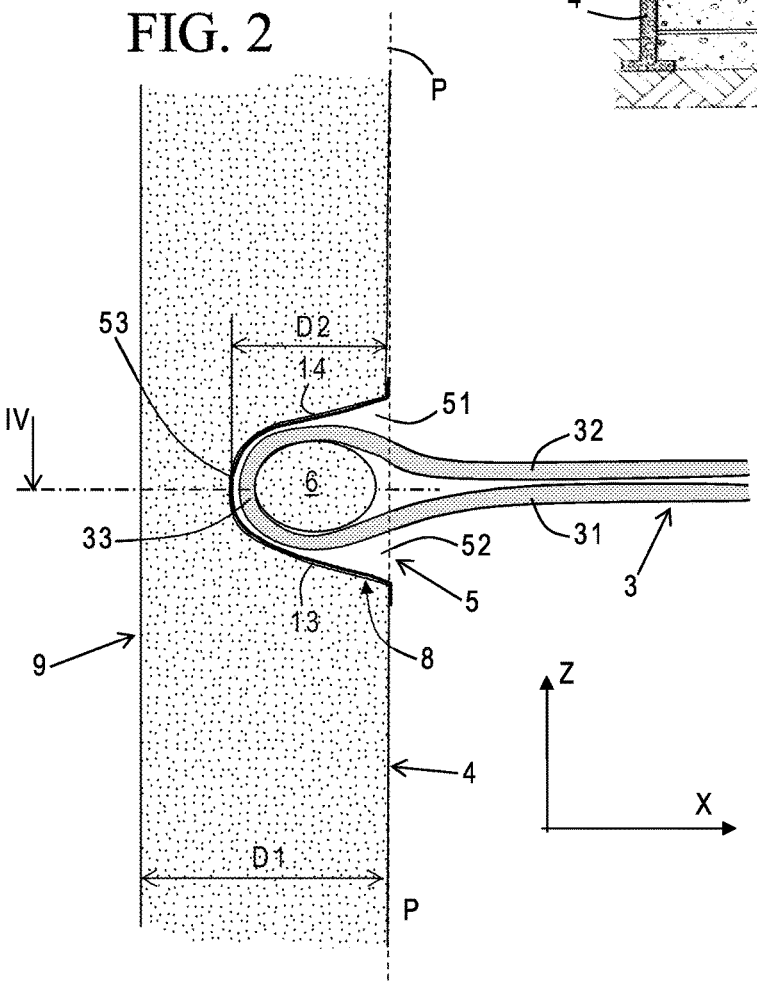
FIG. 2 shows a detailed view in cross section of the connection of a reinforcement at the rear of the facing.

FIG. 1 shows a civil-engineering structure 90 according to the invention, comprising:

a facing 9 extending from a foundation which, in the example shown, is the ground 91, a structure fill 7 situated at the rear of the facing, reinforcements 3 that extend inside the fill and are connected to the facing, or more precisely in anchoring zones 5 provided at the rear of the facing.

The reinforcements 3 fulfil the role of mechanical stabilisation of the fill 92 and provide structural cohesion between the fill 92 and the facing 9, as is known per se.

The facing 9 is substantially vertical as illustrated in FIG. 1 (in the direction denoted "Z"), and comprises a front surface 95 substantially merged with the external front face of the structure and a rear surface 96 situated opposite the front surface 95 and adjacent to the fill 7.

In a Cartesian reference frame, the facing extends generally in a plane YZ with a normal along the axis X, which is perpendicular to the plane. Moreover, a reference plane P is defined at the rear surface 96 of the facing.

In the example illustrated, the facing 9 is a concrete wall, the wall preferably being produced in a modular fashion, as illustrated in FIG. 1, that is to say by the superimposition of prefabricated concrete slabs 4 ("facing blocks" 4), which are assembled on the site of the structure during construction thereof. Because of their weight and bulk, the facing blocks are preferably manufactured in the immediate vicinity of the work site.

It should be noted that the facing 9 may be inclined and that the front face may be planted with vegetation. The space facing the front face may be open to the air or filled with a liquid to be retained.

The fill 7 of the structure may be done with earth and/or stony aggregates, these materials being compacted with a roller in strata. The fill 7 contributes through its weight to the stability of the civil-engineering structure 90 in question.

The fill 7 is produced by installing successive layers from the ground or foundation 91 as far as the top end of the structure. Between each layer, a plurality of reinforcements 3 are disposed substantially in a horizontal plane over the entire surface. The reinforcements 3 can be disposed at a distance from each other along Y and parallel to one another, and in this case they extend from the rear of the facing substantially in the direction X. According to another configuration, the reinforcements 3 may extend aslant with respect to the direction X (cf. below and FIGS. 4 and 6).

By means of the inclusion of the reinforcements 3 in the fill 7, in this way what is referred to as a "reinforced ground" is formed.

The reinforcements 3 are produced in the form of reinforcing bands made from synthetic fabric or plastics material, "geotextile band" is also spoken of, a known example is given in the document EP2247797. Each band forming a reinforcement typically has a generally rectangular cross section with a width of 3 to 10 cm, typically 5 cm, and a thickness of between 2 and 6 mm, typically 4 mm; in addition the reinforcement extends over a relatively great length in its so-called longitudinal direction X', namely several metres or even several tens of metres. The reinforcement works essentially in traction along its longitudinal direction, for which it has good strength. The reinforcement can flex in the direction perpendicular to its plane, so as to form a loop around the anchoring core. Twisting about the longitudinal axis is also possible.

In some configurations, the reinforcement 3 is installed in a given horizontal plane forming zigzags, that is to say it enters and leaves the facing block at the attachment zone along X' with a certain angle vis-à-vis the normal direction X.

The interface and the attachment between the reinforcements 3 and the facing 9 is described below in detail, with reference to FIGS. 2-5.

Each of the slabs 4 of the facing comprises at least one attachment zone 5 for receiving and anchoring a reinforcement 3. This attachment zone 5 comprises a cavity 50 forming a recess inside said slab 4, and emerging on the rear surface 96 of the facing 9. Preferably, the cavity 50 emerges only the rear surface 96. The cavity has an anchoring core 6 passing through it along the axis Y, an anchoring core around which the reinforcement 3 passes and is held thereon.

The anchoring core 6 delimits and separates a top opening 51 and a bottom opening 52 of the cavity 50.

A reinforcement 3 is installed by fitting one end of the reinforcement through one of the openings, for example the bottom opening. The reinforcement is then pushed so that it turns in the bottom 53 of the cavity and emerges at the top opening. Thus the reinforcement makes a loop around the core with outward length 31, a loop portion 33 held by the anchoring core and a return length 32.

It should be noted that the facing blocks have an overall thickness (along X) denoted D1 (typically in the range [10 cm-50 cm]) and that the depth of the cavity from the rear of the facing is denoted D2, D2 being able to be typically between ⅕ and ⅗ of D1.

Figure 11A:
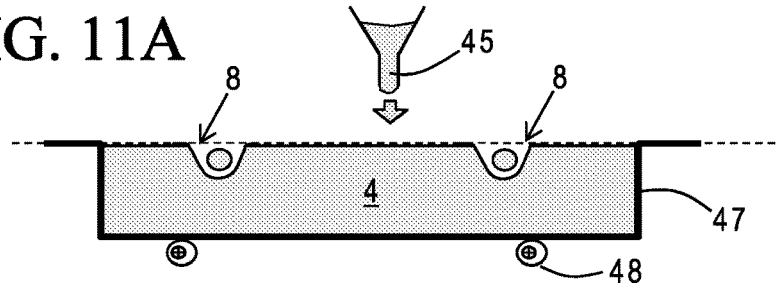
FIG. 11A illustrates the operation of moulding the prefabricated facing block with the moulding inserts in the top position.

Facing blocks are fabricated by pouring liquid concrete into a prefabrication mould 47, and then it is waited until the concrete sets/cures in order to remove it from the mould and move the facing block to the site and install it on the facing being constructed in the structure. FIG. 11A illustrates the step of prefabricating the facing blocks.

A mould 47 with a roughly parallelepipidal shape in the example illustrated is disposed, and one or more moulding inserts 8 by means of which the aforementioned attachment zones 5 are formed are placed inside the moulding form.

Figure 3:
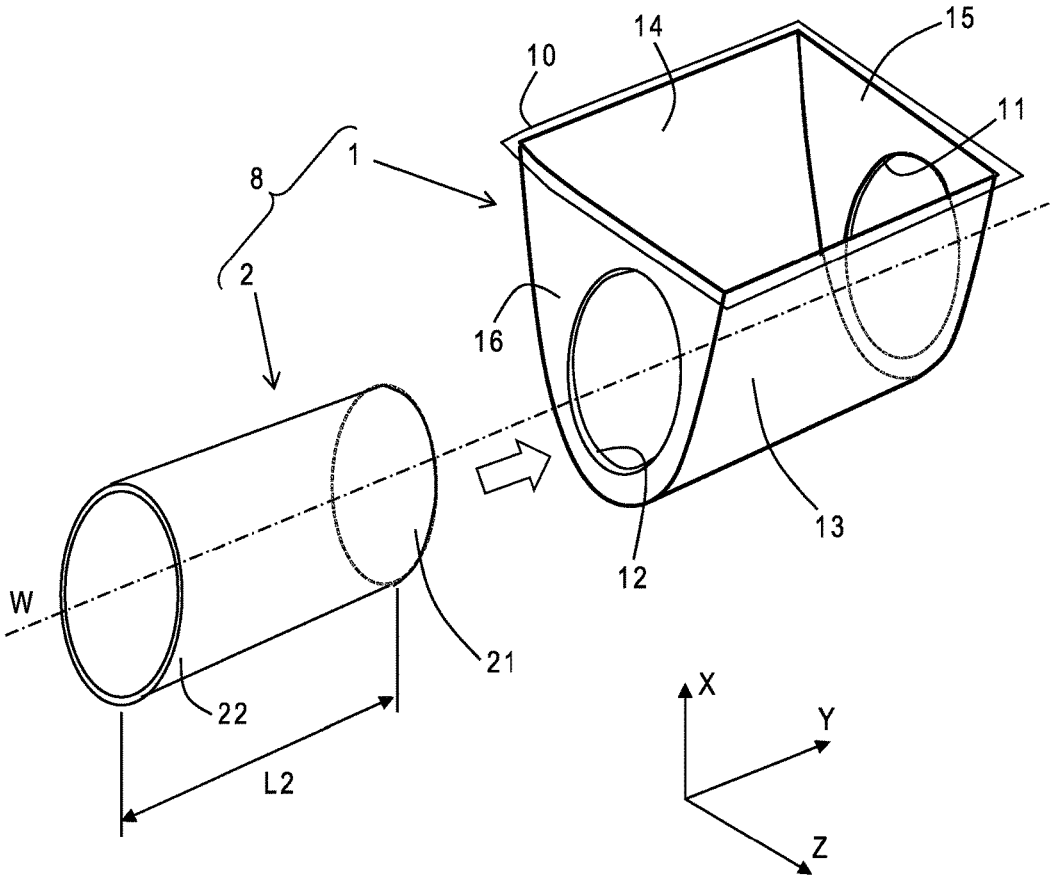
FIG. 3 is an exploded diagram in perspective of the moulding insert used according to the invention.
Figure 4:
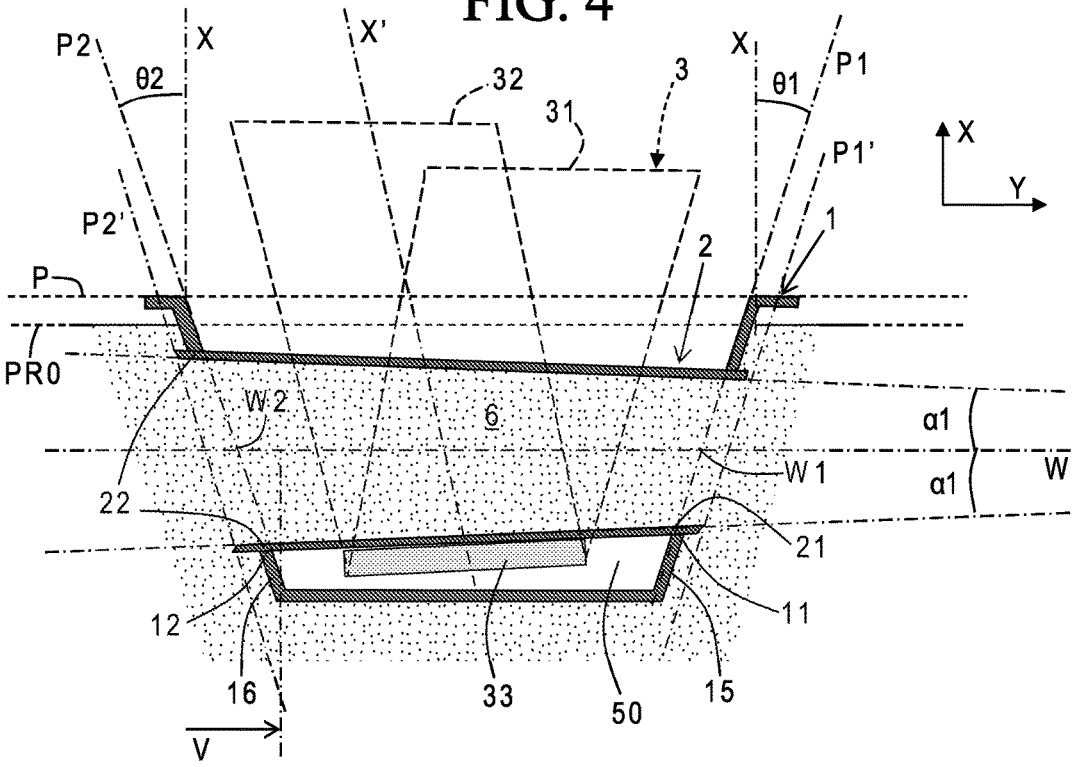
FIG. 4 is a detailed view in cross section of the connection of a reinforcement at the rear of the facing, along the cutting line IV in FIGS. 2 and 5.
Figure 5:
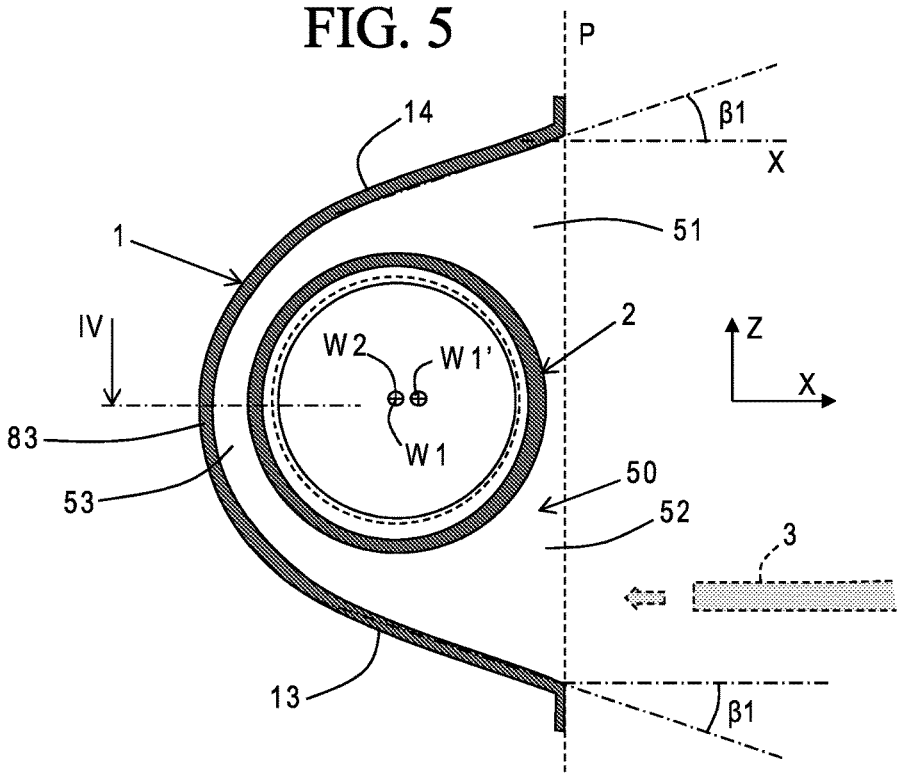
FIG. 5 is a detailed view in cross section of the connection of a reinforcement at the rear of the facing along the cutting line V in FIG. 4.

As illustrated in FIGS. 3, 4, 5, the moulding insert 8 consists of a shell 1 and a core envelope 2.

Each of these parts (core envelope and shell) is obtained by moulding, independently of each other, usually on a site remote from the work site, where they will be assembled for use. Then, on the site where the facing blocks are prefabricated, a core envelope 2 is assembled in a shell 1 in order to form a moulding insert 8 that is placed in the mould 47.

The shell 1 delimits a general space of the connection connecting a reinforcement 3 to the facing block, said general volume opening up by splaying towards the reference plane P, or in other words this space forms a splayed bowl open towards the opening 51, 52 to the outside.

The core envelope is intended to delimit the volume of the concrete anchoring core 6 already mentioned.

It should be noted that the core envelope 2 advantageously has the general shape of a truncated cone centred on the axis denoted W, a conicity the usefulness of which will be seen below. The generatrix base of this truncated cone form is in the example illustrated an ellipse, but naturally any other form could suit.

Generally, the core envelope 2 is summarised as a simple tubular form with a thin wall with a void inside and the two open ends. However, by virtue of the general truncated cone form, it should be noted that the first end portion 21 of the core envelope has dimensions a little less than those of the second end portion 22.

The shell 1 comprises a first lateral face 15 pierced with a first orifice 11, a second lateral face 16 pierced with a second orifice 12, and two other so-called longitudinal faces 13, 14 that join continuously in the bottom zone 83 of the shell (the bottom zone 83 intended to form the bottom of the cavity).

It will be noted that the lateral faces 15, 16 are not parallel; the bottom is narrower and an opening angle (respectively denoted θ1 and θ2) are provided, which gives a general splay to the shell in the direction of the main opening, which is intended to be arranged in the vicinity of the aforementioned reference plane P. Likewise, the longitudinal faces 13, 14 diverge outwards (with an angle denoted β1, cf. FIG. 5) and contribute to the general splaying of the shell.

Figure 8:
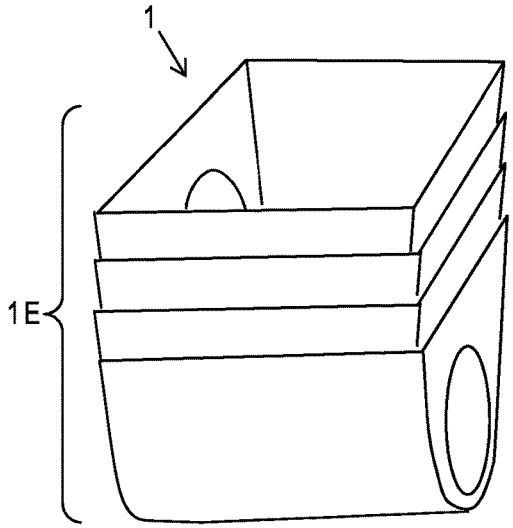
FIG. 8 shows several shells stacked in one another.

Advantageously, by virtue of such a splayed form, a plurality of shells 1 can be stacked in one another as illustrated in FIG. 8. Such an assembly 1E proves to be very compact, the separation between two adjacent stacked shells may be less than one quarter of the depth D2 of the shell.

Figure 7:
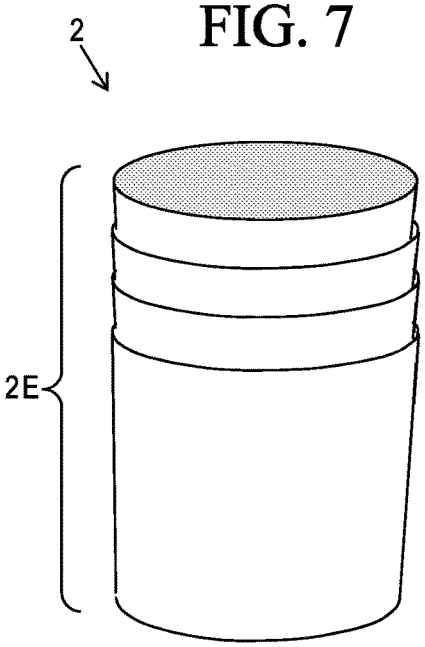
FIG. 7 shows several core envelopes stacked in one another.

It will be noted that the core envelopes 2 also can be stacked in one another as illustrated in FIG. 7. Such an assembly 2E proves to be very compact, and the separation between two adjacent stacked envelopes may be less than one quarter of the axial length L2 of the core envelope (cf. FIG. 3).

It is thus possible firstly to transport many shells in a reduced space and secondly to transport many core envelopes in a reduced space from production sites which may be separate and moreover very distant from the site of the structure 90.

At the time of assembly of the moulding insert 8, the core envelope 2 is fitted with its end portion with the smallest dimension before the movement (as illustrated in FIG. 3) through the second opening 12 of the shell as far as through the first opening 11 of the shell 1.

The result is that the first end portion 21 is fitted in the first opening 11 of the core envelope, and that the second end portion 22 is fitted in the second opening 12 of the core envelope.

The fitting is preferably done without clearance so that the interface between the first end portion and the first orifice 11 forms a continuous closed joint; for this purpose, it is possible to provide a certain flexibility of the material that contributes to taking up any possible dispersion in manufacture. Likewise, at the second orifice 12, the fitting is preferably done without clearance.

Advantageously, in order to obtain good fitting, in other words good wedging of the core envelope 2 in the orifices 11, 12 of the shell, a conicity $\alpha 1$ of between 1° and 10° is provided, preferably around 5°.

In the example illustrated, the core envelope 2 forms an exact truncated cone, that is to say the first elliptical end portion is homothetic with respect to the second end portion.

In addition, provision is made for the ratio of the size of the first and second orifices (11, 12) to correspond to the ratio of the cross sections of the first and second end portions (21, 22), which guarantees simultaneous placement at the two orifices during the insertion movement.

To prevent the core envelope excessively projecting beyond the lateral faces 15, 16 of the shell, provision is also made for the axial ends of the core envelope to be truncated, each following a bevel on the planes P1' and P2', adjacent and offset towards the outside with respect to the planes P1 and P2 in which respectively the first lateral face 15 and the second lateral face 16 lie.

In FIG. 4, the axis W is parallel to the reference plane P, that is to say the point W1 where the plane P1 and the axis W intersect and the point W2 where the plane P2 and the axis W intersect are situated at the same distance from the reference plane P.

Figure 6:
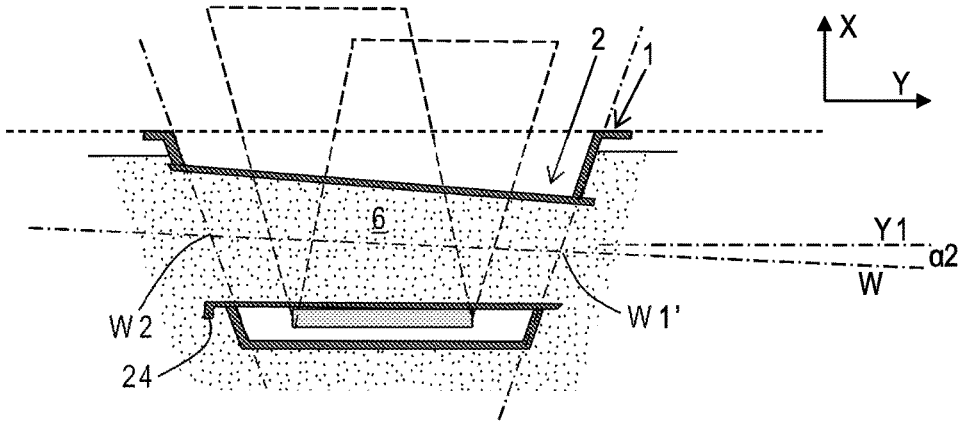
FIG. 6 is a view similar to FIG. 4 according to a variant embodiment.

On the other hand, in FIG. 6, the axis W is not parallel to the reference plane P, and is separated therefrom by an angle $\alpha 2$. More precisely, the point W1' where the plane P1 and the axis W intersect is further away from the reference plane than the point W2 where the plane P2 and the axis W intersect. Advantageously, according to this provision, when the angle $\alpha 2$ is close to $\alpha 1$, or even preferably slightly greater than $\alpha 1$, the reinforcement band 3 makes a loop "flat" on the rear of the anchoring core 6 and consequently each side of the band travels over the same distance in the attachment zone 5 inside the facing. Creating an imbalance that could increase the stresses on one side of the reinforcement band 3 is thus avoided.

When liquid concrete 45 is poured into the prefabrication mould 47, which is vibrated with vibrators 48, the concrete 45 enters the void space in the middle of the core envelope 2 in order to form the anchoring core 6, and in addition concrete follows the lateral faces 15 and 16 and the longitudinal faces 13, 14 of the shell, without however entering the cavity 50 provided for the passage and anchoring of the reinforcement. Inserting a metal reinforcement (not shown) in the core along the axis W is also possible.

Furthermore, a stop collar 24 may be provided on the second end (and therefore the larger one) of the core envelope 2, as can be seen in FIG. 6. This collar limits the travel of the core envelope during the insertion movement.

Moreover, notches (not shown), which serve for snapping on, and which provide a sensory feedback for the operator inserting the core envelope in the shell, may be provided.

Figure 12:
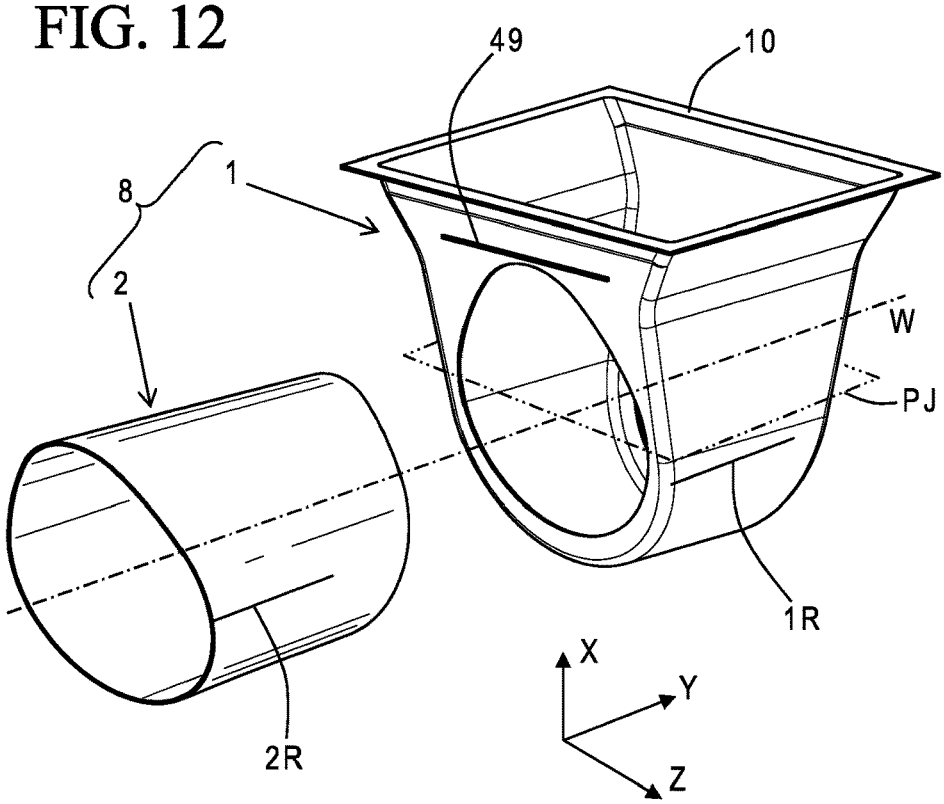
FIG. 12 is an exploded perspective view of the moulding insert used according to the invention.

Advantageously, alignment marks may be provided, on the shell 1R and on the envelope 2R, which enable the operator to correctly orient the core envelope about its axis W during the insertion operation (cf. FIG. 12).

Furthermore, a minimum filling mark 49 for the mould is provided on the shell 1, corresponding to a marked level PR0 in FIG. 4, the minimum level that guarantees sufficient anchoring tensile strength.

Naturally, the moulding insert 8 is set in the concrete and forms an integral part of the finished facing block 4 ready for use on the facing.

Figure 9:
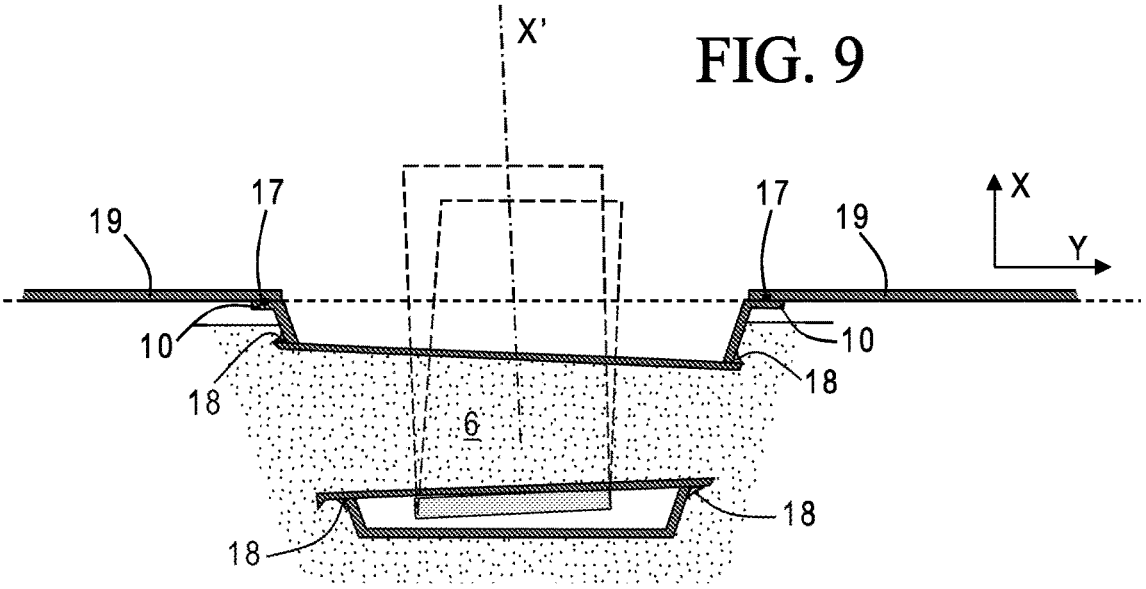
FIG. 9 is a view similar to FIG. 4 according to a variant embodiment.

FIG. 9 illustrates a variant where the facing 9 must have good impermeability to liquids during the life of the structure. Consequently not only must the moulding insert 8 form an obstacle to the penetration of the liquid concrete during the moulding phase, but also must be impervious to liquids during the service life of the structure. To this end, apart from the adjusted fitting already presented above, provision is made for adding a heat-welding joint 18 over the entire periphery of the interface of the core envelope on the shell; it should be noted that access for carrying out this heat welding from outside is easy after insertion of the core envelope in position in the shell.

In addition, at the rear of the facing block, a sealing membrane 19 is provided, which may be produced from plastics material, for example high-density polyethylene (PEHD) or other thermoplastic polymer. This sealing membrane 19 (or "sealing sheet") is adjacent to the rear surface 96 of the concrete facing proper.

This sealing membrane 19 is welded to the rim 10 of the shell by a heat-welding bead 17.

It should be noted that the joint 17 between the sealing membrane 19 and the rim 10 of the shell may be achieved by adhesive bonding or heat welding or any other means known in the art.

The sealing membrane 19 is preferably already installed on the facing part before installation on the structure.

Figure 11B:
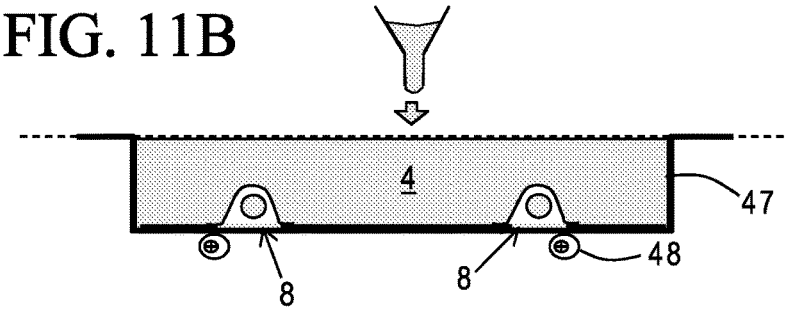
FIG. 11B is similar to FIG. 10 with moulding inserts in the bottom position and a sealing membrane.

This is because, as illustrated in FIG. 11B, after cutting a sealing membrane to the size of the facing block, rectangular openings provided at the attachment zones 5 are formed therein. Then the aforementioned moulding inserts 8 are prepared and fixed (by adhesive bonding or heat welding) at the openings formed in the sealing membrane. Next the sealing sheet 19 equipped with moulding inserts are placed in the bottom of the mould (FIG. 11B), and the liquid concrete 45 is poured.

The method for assembling the civil-engineering structure 90 according to the invention is not described in detail here since it is known per se. The fill material is installed in strata up to a level where the attachment zones are provided; then tamping is carried out with a compactor; then the reinforcements are installed; then this recommences for the following layer, and so on up to the top of the structure.

Concerning the facing, it can also be erected in strata at the same time as the fill and the reinforcements, or can be erected in advance.

With regard to the arrangements on the sealing of the whole of the facing in service, the operations for making the sealing connections at the interface of the facing blocks are described in the document EP 2567032 (case 564).

Concerning the materials, the shell and the core envelope 2 are moulded from injectable thermoplastic material, of the polyethylene, polyolefin or polypropylene type or any other equivalent material. The thickness of the wall will typically be between 0.5 mm and 2 mm.

It should be noted that the wall thickness and the strength of these parts will be calculated so as to satisfy their assembly and up to the operation of pouring concrete inclusive, since, once the concrete is poured, it is the concrete that gives the rigidity to the whole, and the shell and the core envelope then merely have a role of protection against contact vis-à-vis the reinforcement 3. It would be possible to provide small reinforcing ribs in order to optimise the overall thickness of the shell 1 and of the core envelope 2.

Figure 10:
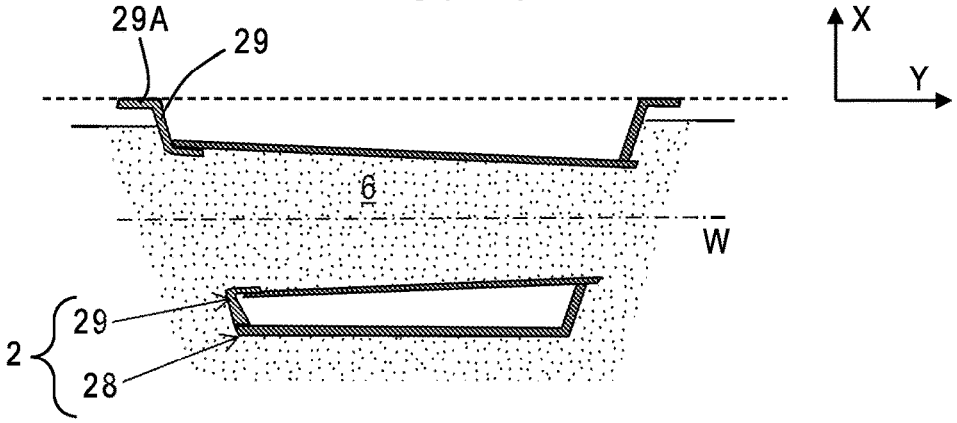
FIG. 10 is a view similar to FIG. 4 according to another embodiment.

FIG. 10 illustrates a variant according to which the shell is formed in two parts, namely a body 28 that comprises the first orifice and a cover 29 that comprises the second orifice. It is possible for example to insert the core envelope in the body 28 and then to introduce the cover 29 on top, which interfaces both the body and the core envelope from the inside, as shown in FIG. 10. According to a particular embodiment, the cover and the body could be articulated at a hinge zone and be designed so that the cover closes towards the final position illustrated. Thus the shell would be obtained by a single moulding operation.

FIG. 12 shows firstly the joint face PJ where the shell is removed from the mould and secondly an ovoid form for the anchoring core. This particularly optimised ovoid form is described in detail in the document U.S. Pat. No. 8,790,045; it should be noted that the rear half is very close to a semi-cylindrical form, which assists in giving a homogeneous radius of curvature for the reinforcement in its loop 1E around the core; the front half is more elliptical, which makes it possible to have top and bottom openings that are very open in order to assist all the configurations of entry and exit of a reinforcement.

The invention claimed is:

1. A moulding insert, configured so as to be inserted in a mould for manufacturing a concrete facing block intended for a reinforced-ground structure, said reinforcement-ground structure comprising a facing formed by such facing blocks and a fill in which reinforcements are installed, connected to the facing, the moulding insert comprising:

a shell, delimiting a general space of a connection connecting a reinforcement to the facing block, said general space opening up while splaying towards a reference plane P defined at a rear surface of the facing, a core envelope, obtained by moulding, separately from the shell, the shell having a first lateral face pierced with a first orifice, in which a first end portion of the core envelope is fitted, characterised in that the core envelope is in the general form of a truncated cone, the shell having a second lateral face pierced with a second orifice, in which a second end portion of the core envelope is fitted, in which the conicity ($\alpha$1) of the core envelope is between 1° and 10°, the second orifice is larger than the first orifice.

2. The moulding insert according to claim 1, wherein the conical form of the core envelope is tightly fitted in the first end portion and the second end portion.

3. The moulding insert according to claim 1, in which the first orifice has a form corresponding to the form of the first end portion and the second orifice has a form corresponding to the form of the second end portion.

4. The moulding insert according to claim 1, in which preferably the two orifices have similar forms and the ratio of their sizes corresponds to the ratio of the cross sections of the first and second end portions.

5. The moulding insert according to claim 1, in which the shell is obtained by moulding in a single piece.

6. The moulding insert according to claim 1, in which the shell and the core envelope are moulded from injectable thermoplastic material, of the polyethylene, polyolefin or polypropylene type.

7. The moulding insert according to claim 1, in which a specific welding joint can be formed at the interface between the core envelope and the shell.

8. The moulding insert according to claim 1, in which the shell can abut against a rear sealing membrane of the block, by means of a rim arranged in the reference plane P.

9. The moulding insert according to claim 1, in which the reference cross section of the conical core envelope is an ovoid form.

10. The moulding insert according to claim 1, in which the respective centres of the first and second orifices have positions offset in distance with respect to the reference plane P, so that the axis of the envelope of the core W has an inclination ($\alpha$2) vis-à-vis the reference plane.

11. A method for producing a moulding insert:

providing a shell, designed to delimit a general space of a connection connecting a reinforcement to a facing block of a facing of a reinforced-ground structure, said general space opening up by splaying towards a reference plane P defined at a rear surface of the facing, providing a core envelope, obtained by moulding the shell separately, the core envelope having the general form of a truncated cone, assembling the core envelope in the shell, the shell having a first lateral face pierced with a first orifice, in which a first end portion of the core envelope is fitted, the shell having a second lateral face pierced with a second orifice, in which a second end portion of the core envelope is fitted, in which the conicity ($\alpha$1) of the core envelope is between 1° and 10°, the second orifice is larger than the first orifice.

12. A facing block comprising at least one moulding insert according to claim 1.

13. A reinforced-ground structure, comprising at least one facing block according to claim 12.

* * * * *